US005762279A

United States Patent [19]

Horton, III

[11] Patent Number: 5,762,279

[45] Date of Patent: Jun. 9, 1998

[54] DUAL DRAW WORKS HEAVY HOISTING APPARATUS

[75] Inventor: Edward E. Horton, III, Houston, Tex.

[73] Assignee: Deep Oil Technology, Incorporated, Houston, Tex.

[21] Appl. No.: 833,773

[22] Filed: Apr. 9, 1997

[51] Int. Cl.[6] ..... B66D 1/26

[52] U.S. Cl. ..... 254/285; 254/337

[58] Field of Search ..... 254/278, 284, 254/285, 286, 290, 337

[56] References Cited

U.S. PATENT DOCUMENTS

| | | | |
|---|---|---|---|
| 769,902 | 9/1904 | Hunt | 254/285 |
| 794,023 | 7/1905 | Kambish, Jr. | 254/285 |
| 1,414,795 | 5/1922 | Suman et al. | 254/285 |
| 2,363,965 | 8/1944 | Mutch | 254/285 |
| 3,658,297 | 4/1972 | Moore et al. | 254/286 |
| 4,144,974 | 3/1979 | Longthorpe | 254/285 |
| 4,360,112 | 11/1982 | Brewer et al. | 254/285 |
| 4,423,994 | 1/1984 | Schefers et al. | 254/285 |

*Primary Examiner*—Katherine Matecki

*Attorney, Agent, or Firm*—Robert J. Edwards; D. Neil LaHaye

[57] ABSTRACT

A dual draw works hoisting apparatus. A single derrick structure is provided for two drilling rigs. The crown block platform receives the crown blocks for both drilling operations such that both crown blocks are slidable along the crown block platform. The hoisting lines are reaved in a conventional manner, except for the dead lines. The dead lines from the two crown blocks are connected together by means of a sheave assembly which is locked in position during normal independent operation of the crown blocks and their respective travelling blocks. To provide increased lifting capacity for lifting the drilling riser, the crown blocks are moved closer together on the platform such that the travelling blocks may be attached to a spreader bar to be positioned above a drill slot and attached to the drilling riser. The sheave assembly connecting the two deadlines is unlocked to allow relative movement between the two deadlines during simultaneous use of the draw works for both travelling blocks. This allows the dead line loads to be equalized even though the separate draw works do not rotate at precisely the same speed.

2 Claims, 2 Drawing Sheets

DUAL DRAW WORKS HEAVY HOISTING APPARATUS

BACKGROUND OF THE INVENTION

1. Field of the Invention

The invention is generally related to offshore drilling operations and more particularly to a hoist for lifting a drilling riser.

2. General Background

Offshore drilling operations are moving into ever increasing water depths and because of this, offshore drilling operators are designing drilling rigs to work in water depths of 10,000 feet and greater. Drilling contractors are designing and marketing vessels or offshore structures that are equipped with two drilling rigs capable of allowing two holes to be drilled simultaneously.

In deep water, the weight of the drilling riser presents a special weight problem that must be dealt with when running or retrieving the drill riser. For example, a 21 inch diameter, 10,000 foot drilling riser together with its choke, kill, and auxiliary lines weighs approximately 3,000,000 pounds in seawater if it is bare, that is, if it does not have flotation modules to provide buoyancy to offset its weight. Normally, the subsea BOP (blow out preventer) stack, which weighs 450,000 pounds, is carried on the end of the riser. Therefore, the 10,000 foot riser would require a drilling rig having a capacity of 3,450,000 pounds to handle this riser.

This load of the riser and subsea BOP stack could be reduced by adding flotation modules to the riser to offset the weight of the subsea BOP stack. The typical cost for adding flotation modules is approximately $3.00 per pound of weight to be supported Thus, the required capacity of the derrick could be reduced to 3,000,000 pounds by adding buoyancy modules to offset the 450,000 pound weight of the subsea BOP stack. This would result in an additional cost of approximately $1,350,000. Even with the required lifting capacity reduced, a problem still exists.

Typically, heavy duty drilling rigs have a hoisting capacity of 1,300,000 pounds, with some having a lifting capacity as high as 1,700,000 pounds. Drilling rigs having a lifting capacity greater than this are very special and limited in availability. Therefore, it becomes apparent that the cost of adding flotation to the riser or increasing the capacity of the drilling rig to the extent required may be prohibitive. This is particularly so since running and retrieving the riser is normally no more than a one time operation for each hole to be drilled and the hoisting capacity of a single drilling rig is adequate to meet the drilling requirements. Thus, this leaves a need for increased hoisting capacity without a prohibitive cost increase.

SUMMARY OF THE INVENTION

The invention addresses the above need. What is provided is a dual draw works hoisting apparatus. The hoisting apparatus is particularly directed to offshore structures having two drilling rigs. A single derrick structure is provided for both drilling rigs. The crown block platform receives the crown blocks for both drilling operations such that both crown blocks are slidable along the crown block platform. The hoisting lines are reaved in a conventional manner, except for the dead lines. The dead lines from the two crown blocks are connected together by means of a sheave assembly which is locked in position during normal independent operation of the crown blocks and their respective travelling blocks. To provide increased lifting capacity for lifting the drilling riser, the crown blocks are moved closer together on the platform such that the travelling blocks may be attached to a spreader bar to be positioned above a drill slot and attached to the drilling riser. The sheave assembly connecting the two deadlines is unlocked to allow movement of the two deadlines during simultaneous use of the draw works for both travelling blocks. This allows the dead line loads to be equalized even though the separate draw works do not rotate at precisely the same speed and also keeps the spreader bar level.

BRIEF DESCRIPTION OF THE DRAWINGS

For a further understanding of the nature and objects of the present invention reference should be had to the following description, taken in conjunction with the accompanying drawings in which like parts are given like reference numerals, and wherein.

DETAILED DESCRIPTION OF THE PREFERRED EMBODIMENT

Figure 1:
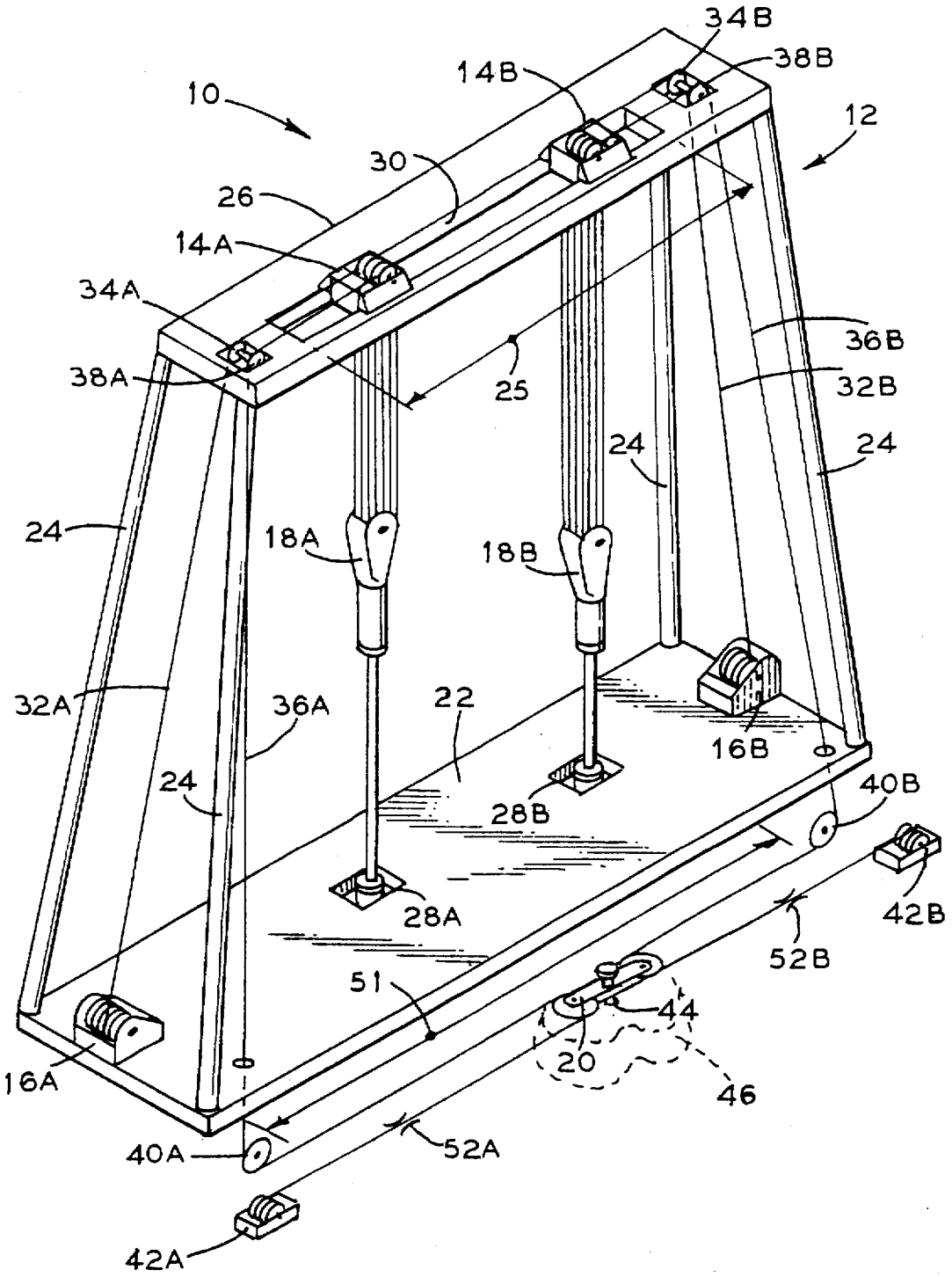
FIG. 1 illustrates the invention with the crown blocks and travelling blocks in their normal position during drilling operations.

Referring to the drawings, it is seen in FIG. 1 that the invention is generally indicated by the numeral 10. The dual draw works hoisting apparatus 10 is generally comprised of a derrick 12, crown blocks 14 A and B, draw works 16 A and B, travelling blocks 18 A and B, and deadline connecting assembly 20. Each set of crown blocks 14, draw works 16, travelling blocks 18, and associated lines comprise a single hoisting apparatus.

The derrick 12 is formed from derrick floor 22, legs 24, and crown block platform 26 and is positioned at the appropriate location on the offshore structure. The derrick floor 22 is provided with drill slots 28 A and B to accommodate the drill string and drilling riser. The legs 24 are rigidly attached to each corner of the derrick floor 22 and extend upwardly therefrom. The crown block platform 26 is attached to the upper ends of the legs 24. The crown block platform 26 is provided with a longitudinal slot 30 along its length to slidably receive the crown blocks 14. This allows the crown blocks 14 to be moved across the range indicated by arrow 25.

Figure 2:
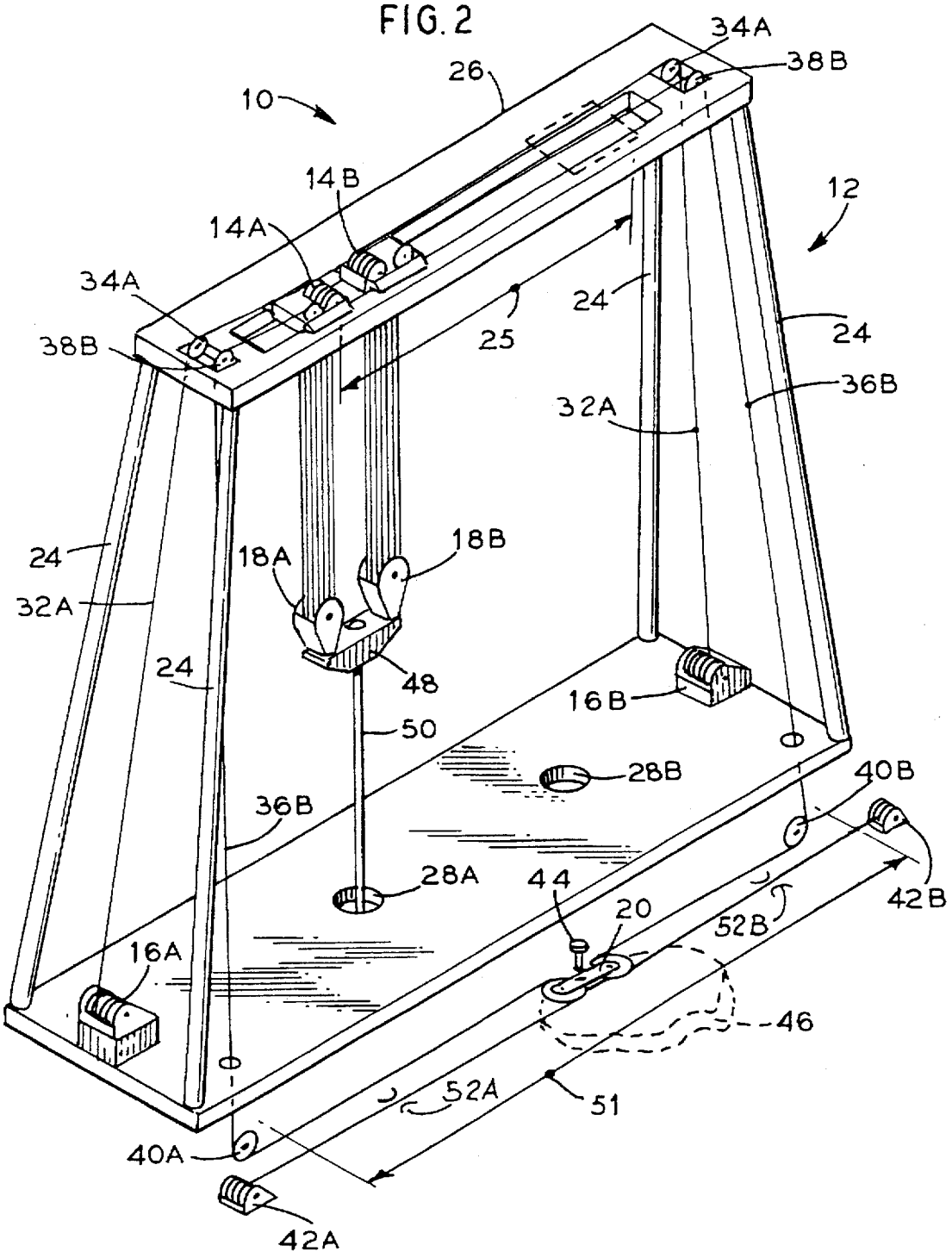
FIG. 2 illustrates the invention with the crown blocks and travelling blocks in position for hoisting the drilling riser.

The crown blocks 14 are slidable between a first position which is normal during drilling operations, seen in FIG. 1, and a second heavy hoisting position, seen in FIG. 2. In the first position, the crown blocks 14 and travelling blocks 18 are positioned over their respective drill slots 28 and are used in the normal manner during drilling operations. En the second heavy hoisting position, seen in FIG. 2, the crown blocks 14 and travelling blocks 18 are moved in the longitudinal slot 30 such that they are positioned on either side of the drill slot from which a riser must be run or retrieved.

As seen in both FIG. 1 and 2, the hoisting lines are reaved in a conventional manner, with the exception of the dead lines. The fast lines 32 A,B are respectively run from the draw works 16, which are rigidly mounted on the derrick floor 22, around fastline fairleads 34, through the crown blocks 14, and around the pulleys on travelling blocks 18. The deadlines 36 A and B are run around the upper deadline fairleads 38 A and B, around lower deadline fairleads 40 A and B, around deadline connecting assembly 20, and to storage drums 42 A and B. The deadline connecting assembly 20 is formed from a plate having a bore substantially through its center and a sheave at each end for receiving the deadline from each hoisting apparatus. In a normal hoisting arrangement, the deadlines would be led directly to the storage drums.

Means for selectively locking the deadline connecting assembly 20 in a stationary position is provided in the form of a locking pin 44. During normal drilling or hoisting operations when a single draw works, crown block, and travelling block have sufficient lifting capacity, the deadline connecting assembly 20 is locked in position by the locking pin 44, which fits through the deadline connector assembly 20 and into a bore in the offshore structure 46. In this setup, seen in FIG. 1, each set of draw works, crown block, and travelling block act independently of each other.

During hoisting of the drilling riser, when lifting capacity beyond that of a single hoisting rig is required, the pin 44 is removed from the deadline connecting assembly 20 and the crown blocks 14 are moved into their second heavy hoisting position as seen in FIG. 2. A spreader bar 48 is attached to both travelling blocks 18 and the spreader bar 48 is attached to the drilling riser 50. Both draw works 16 are then activated to hoist the drilling riser 50. With the locking pin 44 disengaged, the deadline connecting assembly 20 is free to travel horizontally across the range indicated by the arrow 51. Allowing the deadline connecting assembly to travel causes the deadline loads to be equalized even though the draw works 16 A and B may not rotate at precisely the same speeds. Equalizing the deadline load keeps the two travelling blocks 18 A and B even which in turn keeps the spreader bar 48 level. Deadline stoppers 52 A and B are illustrated schematically and are conventional designs which comprise a small drum over which a number of drill line wraps are made to serve as a deadman. Generally, this device has a built-in weight indicator which allows the operator to read the deadline tension.

The invention provides several advantages. It reduces or eliminates the need for expensive flotation to offset the weight of the drilling riser in sea water. It allows the horsepower and braking capacity of both draw works to be utilized for running and retrieving the riser. It eliminates the need for reaving and unreaving the drilling lines to increase or decrease the hook load capacity, which is a time consuming operation. It also eliminates the need for increasing the capacity of the rig to carry out the relatively infrequent operation of running and retrieving the riser.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. In a structure used for drilling or producing hydrocarbons and having two drilling rigs, a dual draw works hoisting apparatus, comprising:

a. a derrick attached to said structure, said derrick having a derrick floor and a crown block platform;

b. two hoisting apparatuses, each hoisting apparatus having a crown block, draw works, traveling block, fast line, and deadline, with the crown block of each hoisting apparatus being slidably received on the crown block platform of said derrick such that the crown blocks are movable between a first position for normal drilling operations and a second heavy hoisting position;

c. a deadline connecting assembly which receives the deadline from each hoisting apparatus and connects the deadlines to each other; and d. means for selectively locking said deadline connecting assembly in a stationary position such that each hoisting apparatus acts independently, or unlocking said deadline connecting assembly to allow movement thereof whereby said two hoisting apparatuses may be used in combination as a single hoisting apparatus.

2. The apparatus of claim 1, further comprising a spreader bar attached between the travelling blocks of said hoisting apparatuses during their combined use.

* * * * *